US010952294B2

(12) United States Patent
Lin

(10) Patent No.: US 10,952,294 B2
(45) Date of Patent: Mar. 16, 2021

(54) DRIVING METHOD AND DRIVING APPARATUS FOR LIGHT EMITTING DIODES IN KEYBOARD

(71) Applicant: Yi-Hua Lin, Hsinchu County (TW)

(72) Inventor: Yi-Hua Lin, Hsinchu County (TW)

(73) Assignee: ITE Tech. Inc., Hsinchu (TW)

( * ) Notice: Subject to any disclaimer, the term of this patent is extended or adjusted under 35 U.S.C. 154(b) by 60 days.

(21) Appl. No.: 16/413,620

(22) Filed: May 16, 2019

(65) Prior Publication Data

US 2020/0178365 A1 Jun. 4, 2020

(30) Foreign Application Priority Data

Dec. 4, 2018 (TW) ..... 107143412

(51) Int. Cl.
*H05B 45/00* (2020.01)
*H05B 45/20* (2020.01)
*H01H 13/83* (2006.01)

(52) U.S. Cl.
CPC ..... *H05B 45/20* (2020.01); *H01H 13/83* (2013.01)

(58) Field of Classification Search
CPC ..... H05B 45/20; H05B 45/30; H05B 45/44; H05B 45/52; H05B 45/54; G06F 3/0232; H01H 13/83
See application file for complete search history.

(56) References Cited

U.S. PATENT DOCUMENTS 7,333,031 B1 * 2/2008 Bantner ..... G06F 3/0238 341/22
10,212,793 B1 * 2/2019 Plancherel ..... H05B 45/20
2010/0134020 A1 * 6/2010 Peng ..... H05B 31/50 315/133
2010/0302162 A1 * 12/2010 Jo ..... G06F 3/0202 345/168
2010/0302169 A1 * 12/2010 Pance ..... G06F 3/0237 345/170
2018/0067566 A1 * 3/2018 Potts ..... G06F 3/0227
2020/0050284 A1 * 2/2020 Toyosawa ..... H01H 13/00

FOREIGN PATENT DOCUMENTS

CN 102945081 2/2013
CN 102969186 3/2013
CN 104763971 7/2015
CN 208001388 10/2018

OTHER PUBLICATIONS

"Office Action of Taiwan Counterpart Application," dated Aug. 26, 2019, p. 1-3.

* cited by examiner

*Primary Examiner* — Tung X Le
(74) *Attorney, Agent, or Firm* — JCIPRNET

(57) ABSTRACT

A driving method and driving apparatus for light emitting diodes in a keyboard are provided. The driving method includes the following steps: obtaining a first driver color data table unmatched with a key light driver array from a first memory; generating a second driver color data table matched with the key light driver array in a second memory according to an arrangement order of keys in the key light driver array and the first driver color data table; driving the key light driver array according to the second driver color data table; and driving the light emitting diodes corresponding to keys in the keyboard through the key light driver array.

21 Claims, 11 Drawing Sheets

PC
PA
PD
730
742
710
722
PB
700

| | CR0 | CR1 | CR2 | CR3 | CR4 | CR5 | CR6 | CR7 | CR8 | CR9 | CR10 | CR11 | CR12 | CR13 | CR14 | CR15 |
|---|---|---|---|---|---|---|---|---|---|---|---|---|---|---|---|---|
| RR0 | 0x01 DBGR [0,0] | 0x12 DBGR [0,1] | 0x10 DBGR [0,2] | 0x03 DBGR [0,3] | 0x04 DBGR [0,4] | 0x06 DBGR [0,5] | 0x26 DBGR [0,6] | 0x17 DBGR [0,7] | 0x19 DBGR [0,8] | 0x29 DBGR [0,9] | 0x09 DBGR [0,10] | 0x0A DBGR [0,11] | 0x2C DBGR [0,12] | 0x0B DBGR [0,13] | 0x1E DBGR [0,14] | |
| RR1 | 0x00 DBGR [1,0] | 0x32 DBGR [1,1] | 0x02 DBGR [1,2] | 0x22 DBGR [1,3] | 0x24 DBGR [1,4] | 0x05 DBGR [1,5] | 0x27 DBGR [1,6] | 0x07 DBGR [1,7] | 0x18 DBGR [1,8] | 0x28 DBGR [1,9] | 0x08 DBGR [1,10] | 0x0C DBGR [1,11] | 0x1C DBGR [1,12] | 0x0E DBGR [1,13] | 0x0F DBGR [1,14] | 0x1F DBGR [1,15] |
| RR2 | 0x20 DBGR [2,0] | 0x23 DBGR [2,1] | 0x14 DBGR [2,2] | 0x15 DBGR [2,3] | 0x33 DBGR [2,4] | 0x35 DBGR [2,5] | 0x36 DBGR [2,6] | 0x38 DBGR [2,7] | 0x59 DBGR [2,8] | 0x1A DBGR [2,9] | 0x39 DBGR [2,10] | 0x1B DBGR [2,11] | 0x3B DBGR [2,12] | 0x0D DBGR [2,13] | 0x3C DBGR [2,14] | |
| RR3 | 0x31 DBGR [3,0] | 0x21 DBGR [3,1] | 0x43 DBGR [3,2] | 0x13 DBGR [3,3] | 0x34 DBGR [3,4] | 0x25 DBGR [3,5] | 0x47 DBGR [3,6] | 0x57 DBGR [3,7] | 0x5A DBGR [3,8] | 0x3A DBGR [3,9] | 0x58 DBGR [3,10] | 0x2B DBGR [3,11] | 0x3E DBGR [3,12] | 0x2E DBGR [3,13] | | |
| RR4 | 0x30 DBGR [4,0] | 0x41 DBGR [4,1] | 0x42 DBGR [4,2] | 0x45 DBGR [4,3] | 0x56 DBGR [4,4] | | 0x46 DBGR [4,6] | 0x37 DBGR [4,7] | 0x49 DBGR [4,8] | 0x6A DBGR [4,9] | 0x2A DBGR [4,10] | 0x4B DBGR [4,11] | 0x6C DBGR [4,12] | | 0x5E DBGR [4,14] | |
| RR5 | 0x40 DBGR [5,0] | 0x61 DBGR [5,1] | 0x52 DBGR [5,2] | 0x54 DBGR [5,3] | 0x53 DBGR [5,4] | 0x55 DBGR [5,5] | 0x48 DBGR [5,6] | | 0x68 DBGR [5,8] | 0x4A DBGR [5,9] | 0x7B DBGR [5,10] | 0x7D DBGR [5,11] | | | | |
| RR6 | 0x50 DBGR [6,0] | 0x51 DBGR [6,1] | 0x62 DBGR [6,2] | | 0x44 DBGR [6,4] | | | 0x69 DBGR [6,7] | | | 0x6E DBGR [6,10] | | | 0x7F DBGR [6,13] | | |
| RR7 | 0x60 DBGR [7,0] | | 0x63 DBGR [7,2] | | | 0x65 DBGR [7,5] | | | | | | | 0x4E DBGR [7,12] | | | |

FIG. 7

DRIVING METHOD AND DRIVING APPARATUS FOR LIGHT EMITTING DIODES IN KEYBOARD

CROSS-REFERENCE TO RELATED APPLICATION

This application claims the priority benefit of Taiwan application serial no. 107143412, filed on Dec. 4, 2018. The entirety of the above-mentioned patent application is hereby incorporated by reference herein and made a part of this specification.

BACKGROUND

Technical Field

The invention relates to a driving technology for light emitting diodes. More particularly, the invention relates to a driving method and driving apparatus for light emitting diodes in a keyboard.

Description of Related Art

Nowadays, most of the peripheral devices (e.g., keyboards and mouses) of the computer systems (e.g., notebooks) feature cool sound and light effects to attract users to buy. As regards illuminated keyboards, various full-color and dazzling light changes can be achieved through design. A designer of an illuminated keyboard may establish corresponding driving data according to the arrangement order of the light emitting diodes (i.e., the key lights) corresponding to each key in the keyboard. For instance, the driving data may be used according to a set conditions (e.g., a specific key is pressed), so that the key lights may generate mixed lights of different colors. Accordingly, a variety of effects can be provided on an illuminated keyboard, such as rainbow color variations, wavy color presentation, lighting up specific columns and rows by light emitting diodes, etc.

SUMMARY

The invention provides a driving method and driving apparatus for light emitting diodes in a keyboard capable of rapidly and automatically updating driving data unmatched with an arrangement order of key lights, so as to save time consumed for design and research and development of illumination effects on illuminated keyboards.

A driving method for light emitting diodes in a keyboard disclosed by the invention includes the following steps. A first driver color data table unmatched with a key light driver array is obtained from a first memory. According to an arrangement order of keys in the key light driver array and the first driver color data table, a second driver color data table matched with the key light driver array is generated in a second memory. Moreover, the key light driver array is driven according to the second driver color data table, so as to drive the light emitting diodes corresponding to the keys in the keyboard through the key light driver array.

A driving apparatus for light emitting diodes in a keyboard disclosed by the invention includes a key light driver array, a first memory, a second memory, and a microprocessor. The key light driver array includes the light emitting diodes corresponding to a plurality of keys in the keyboard. The first memory is configured to store or temporarily store a first driver color data table, and the first driver color data table is unmatched with the key light driver array. The microprocessor is coupled to the first memory, the second memory, and the key light driver array. The microprocessor obtains the first driver color data table unmatched with the key light driver array from the first memory and generates a second driver color data table matched with the key light driver array in the second memory according to an arrangement order of the keys in the key light driver array and the first driver color data table. Moreover, the microprocessor drives the key light driver array according to the second driver color data table.

A driving apparatus for light emitting diodes in a keyboard disclosed by the invention includes a key light driver array, a first memory, a second memory, a microprocessor, and a driver control circuit. The key light driver array includes the light emitting diodes corresponding to a plurality of keys in the keyboard. The first memory is configured to store or temporarily store a first driver color data table, and the first driver color data table is unmatched with the key light driver array. The microprocessor is coupled to the first memory, the second memory, and the key light driver array. The driver control circuit is coupled to the second memory and the key light driver array. The microprocessor obtains the first driver color data table unmatched with the key light driver array from the first memory and generates a second driver color data table matched with the key light driver array in the second memory according to an arrangement order of the keys in the key light driver array and the first driver color data table. Moreover, the driver control circuit drives the key light driver array according to the second driver color data table.

A driving method for light emitting diodes in a keyboard disclosed by the invention includes the following steps. A key light number mapping table corresponding to an arrangement order of keys in a key light driver array is generated according to the arrangement order of the keys in the key light driver array. A second driver color data table matched with the key light driver array is generated in a second memory according to a first driver color data table and the key light number mapping table. Moreover, the key light driver array is driven according to the second driver color data table, so as to drive the light emitting diodes corresponding to the keys in the keyboard through the key light driver array.

A driving apparatus for light emitting diodes in a keyboard disclosed by the invention includes a key light driver array, a first memory, a second memory, a third memory, a microprocessor, and a mapping table conversion controller. The key light driver array includes the light emitting diodes corresponding to a plurality of keys in the keyboard. The first memory is configured to store or temporarily store a first driver color data table, and the first driver color data table is unmatched with the key light driver array. The microprocessor is coupled to the first memory, the second memory, the third memory, and the key light driver array. Moreover, the mapping table conversion controller is coupled to the first memory, the second memory, and the third memory. The microprocessor generates the key light number mapping table corresponding to an arrangement order of the keys in the key light driver array in the third memory according to the arrangement order of the keys in the key light driver array. Moreover, the mapping table conversion controller generates a second driver color data table matched with the key light driver array in the second memory according to the first driver color data table and the key light number mapping table. Further, the microprocessor drives the key light driver array according to the second driver color data table.

A driving apparatus for light emitting diodes in a keyboard disclosed by the invention includes a key light driver array, a first memory, a second memory, a third memory, a microprocessor, a mapping table conversion controller, and a driver control circuit. The key light driver array includes the light emitting diodes corresponding to a plurality of keys in the keyboard. The first memory is configured to store or temporarily store a first driver color data table, and the first driver color data table is unmatched with the key light driver array. The microprocessor is coupled to the first memory, the third memory, and the key light driver array. The mapping table conversion controller is coupled to the first memory, the second memory, and the third memory. Moreover, the driver control circuit is coupled to the second memory and the key light driver array. The microprocessor generates the key light number mapping table corresponding to an arrangement order of the keys in the key light driver array in the third memory according to the arrangement order of the keys in the key light driver array. Moreover, the mapping table conversion controller generates a second driver color data table matched with the key light driver array in the second memory according to the first driver color data table and the key light number mapping table. Further, the driver control circuit drives the key light driver array according to the second driver color data table.

To sum up, in the driving method and driving apparatus for light emitting diodes in a keyboard provided by the embodiments of the invention, the second driver color data table matched with the key light driver array is generated through the first driver color data table unmatched with the key light driver array, the arrangement order of the keys in the key light driver array (that is, the present arrangement order of the keys), and the arrangement order of the keys matched with the first driver color data table (that is, the previous arrangement order of the keys). The key light driver array and the light emitting diodes corresponding to the keys are thereby driven. In this way, when positions of the traces on the circuit board carrying the keys and the corresponding key lights are shifted and that the arrangement order of the key lights is unmatched with the driving data (e.g., the driver color data table), the driving data can be rapidly and automatically updated according to the present arrangement order of the keys and the previous arrangement order of the keys in the invention. Therefore, time consumed for design and research and development of illumination effects on illuminated keyboards can be saved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

FIG. 7 is a schematic diagram of a second driver color data table 700 according to an embodiment of the invention.

DESCRIPTION OF THE EMBODIMENTS

Figure 1:
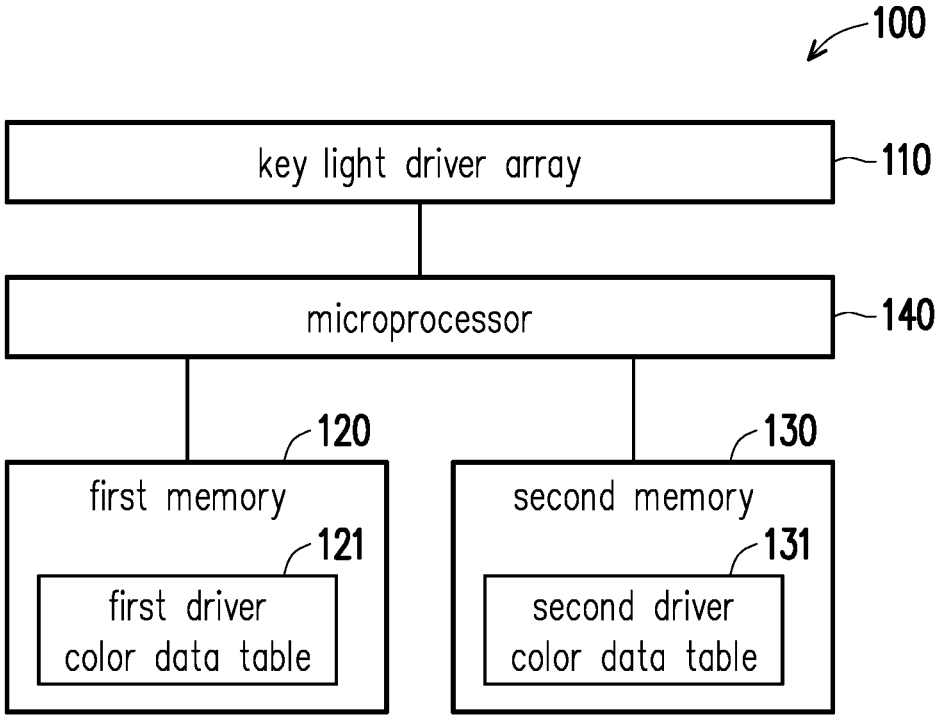
FIG. 1 is a block view of a driving apparatus for light emitting diodes in a keyboard according to an embodiment of the invention.

If an illuminated keyboard used on a notebook is expected to feature effects of various full-color and dazzling light changes, a designer may establish corresponding driving data (e.g., driver color data tables) according to the arrangement relationship of light emitting diodes (e.g., and key lights) of each key in the keyboard and a variety of color patterns. The key light corresponding to each key may be equipped with a variety of colored lights (e.g., red light, green light, and blue light), and various colors may be presented owing to intensity of these colored lights. Next, the light emitting diodes may be rapidly driven through the driving data to enable the key lights to generate mixed lights of different colors according to a set condition (e.g., a specific key is pressed). That is, the abovementioned driving data is established only when the arrangement relationship of the light emitting diodes (e.g., the key lights) of each key in the keyboard is obtained. The driving data (the driver color data tables) may be hundreds or thousands of pieces of data, and the number of the pieces of the driving data may be set according to needs of people applying this embodiment.

Nevertheless, trace setting on a circuit board carrying the keys and the corresponding key lights may be adjusted according to different versions provided by manufacturers. As such, the arrangement relationship of the keys and the corresponding key lights does not correspond to the pre-set driving data (i.e., the arrangement relationship of the keys and the corresponding key lights is not matched with the driving data), and that the abovementioned effects may not be presented. In practical applications, when pins outputted by pulse width modulation (PWM) of the light emitting diode driver in the key light driver array correspond to new key light numbers owning to position shift of the traces on the circuit board, the originally-established plural driver color data tables cannot display the effects on the predetermined positions. As such, the content of the driver color data tables established according to different color patterns has to be manually updated, and much efforts and time may thus be consumed. When the number of the driver color data tables increases, increasing human efforts are also required.

Therefore, based on the needs, a second driver color data table matched with the key light driver array is automatically generated through the arrangement order of the keys in the key light driver array (that is, a present arrangement order of the keys), a first driver color data table unmatched with the key light driver array, and the arrangement order of the keys matched with the first driver color data table (that is, a previous arrangement order of the keys) in the invention. In this way, when the layout or trace of each key on the keyboard on the key light driver array changes (that is, when the present arrangement order of the keys is changed), the driver color data tables are enabled to be automatically adjusted to be new driver color data tables matched with the present arrangement order of the keys according to the present arrangement order of the keys and the previous arrangement order of the keys in the invention. Therefore, the keyboard may present correct and various full-color and dazzling light changes.

FIG. 1 is a block view of a driving apparatus for light emitting diodes in a keyboard according to an embodiment of the invention. With reference to FIG. 1, in this embodiment, a driving apparatus 100 for light emitting diodes in a keyboard includes a key light driver array 110, a first memory 120, a second memory 130, a microprocessor 140, and a plurality of light emitting diodes (LEDs) (not shown in FIG. 1). The first memory 120 is configured to store or temporarily store a first driver color data table 121, and the second memory 130 is configured to store or temporarily store a second driver color data table 131. The driving apparatus 100 may be disposed in a computer system having an illuminated keyboard (e.g., a notebook), in a wired or wireless keyboard equipment, or in other electronic apparatuses.

The key light driver array 110 mainly includes a plurality of light emitting diodes corresponding to a plurality of keys in a keyboard. In this embodiment, the light emitting diodes corresponding to each of the keys (a key light) are soldered to a plurality of LED connection points on a circuit board, and these LED connection points are connected by traces. The circuit board also includes driving connection points configured to drive the light emitting diodes (the key lights), and these driving connection points are connected to corresponding LED drivers. After a circuit board is produced, the traces on the circuit boards cannot be easily changed. The "key light driver array 110" described in this embodiment refers to the light emitting diodes, the traces, and the corresponding LED drivers. The key light driver array 110 also presents a present arrangement order of the keys in the keyboard and a driving order. The "present arrangement order of the keys in the keyboard" is stored in a form of a table to be accessed by the microprocessor 140.

Each of the first memory 120 and the second memory 130 is, for example, a fixed or a movable random access memory (RAM) in any form, a read-only memory (ROM), a flash memory or any other similar device, or a combination of the foregoing devices.

The microprocessor 140 may be, for example, a central processing unit (CPU) or a programmable microprocessor for general or special use, a digital signal processor (DSP), a programmable controller, an application specific integrated circuit (ASIC), a programmable logic device (PLD) or any other similar device, or a combination of the foregoing devices.

Figure 2:
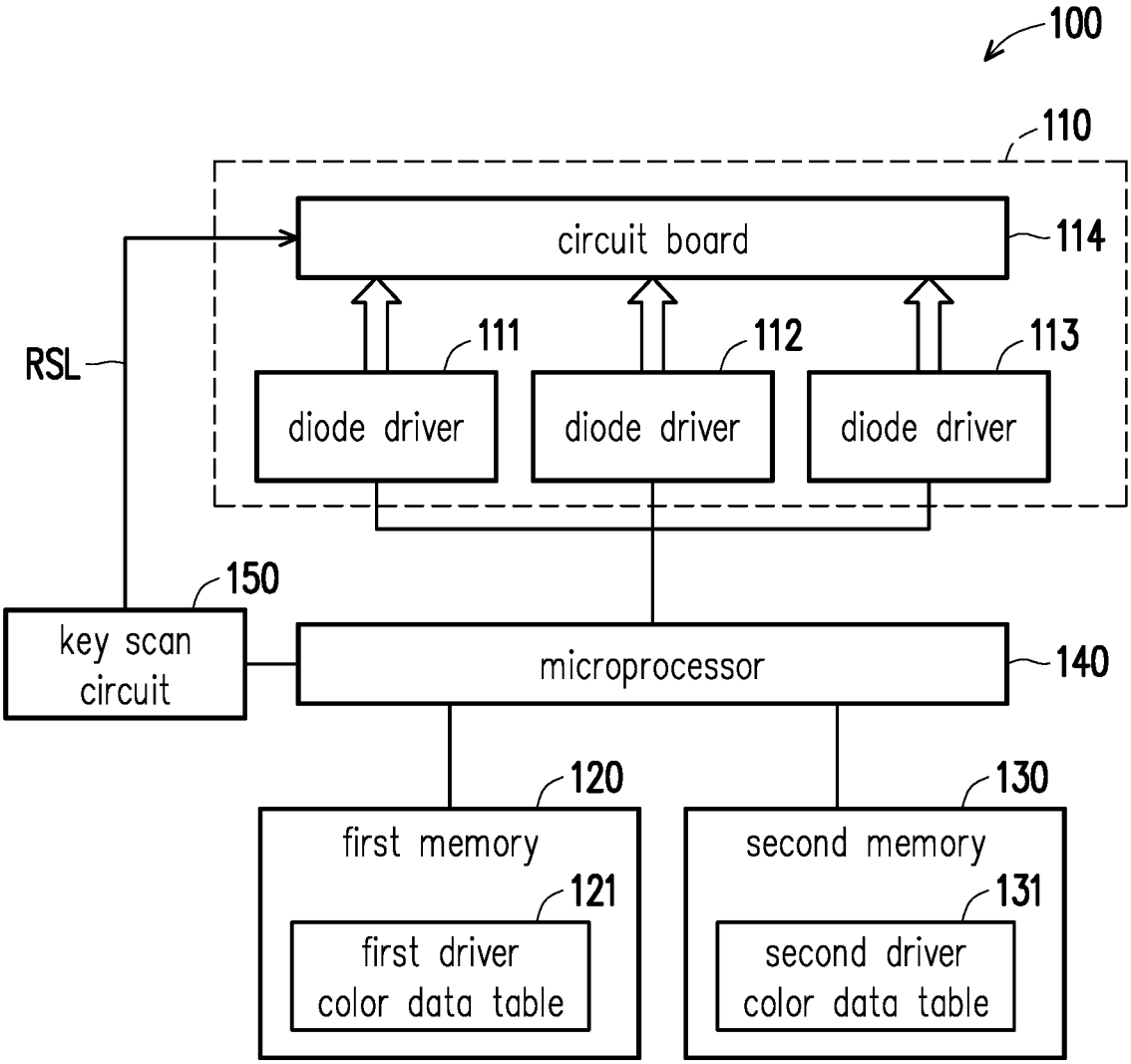
FIG. 2 is a block view illustrating the driving apparatus for light emitting diodes in a keyboard in detail according to an embodiment of the invention.

FIG. 2 is a block view illustrating the driving apparatus 100 for light emitting diodes in a keyboard in detail according to an embodiment of the invention. FIG. 2 mainly discloses a structure of the key light driver array 110 in detail. With reference to FIG. 2, the driving apparatus 100 for light emitting diodes in a keyboard further includes a key scan circuit 150. Moreover, the key light driver array 110 of the driving apparatus 100 for light emitting diodes in a keyboard includes three diode drivers 111, 112, and 113 in addition to a circuit board 114 having a plurality of traces. The traces in the circuit board 114 are configured to connect the corresponding key lights. In this embodiment, each of the key lights includes a blue light emitting diode, a green light emitting diode, and a red light emitting diode. In this embodiment, the diode drivers 111, 112, and 113 respectively control the blue LED, the green LED, and the red LED in each of the key lights. In other embodiments consistent with the invention, the light emitting diode corresponding to each of the keys (i.e., the key light) may be a single monochromatic light emitting diode. Color types and number of the light emitting diodes in the key lights are not limited for people applying this embodiment.

For instance, 8 rows and 16 columns of key lights are disposed on the circuit board 114 in this embodiment. Each of the diode drivers 111, 112, and 113 has sixteen column scan lines, so that each of the key lights in the keyboard is controlled by the column scan lines of the diode drivers 111, 112, and 113. The key scan circuit 150 also provides a plurality of row scan lines RSL (e.g., 8 row scan lines) to the circuit board 114, so that each row of the key lights in the keyboard is controlled by the row scan lines RSL. In this embodiment, the microprocessor 140 may enable the key scan circuit 150 and the diode drivers 111, 112, and 113 to work with driving data (the driver color data tables) matched with the present arrangement order of the keys in the key light driver array 110, so as to light up the same row of key lights at the same moment of time and light up the next row of key lights at the next moment of time, and such order is accordingly applied.

With reference to FIG. 1 and FIG. 2, in this embodiment, the microprocessor 140 is coupled to the first memory 120, the second memory 130, the key light driver array 110, and the key scan circuit 150, so that a driving method for light emitting diodes in a keyboard provided by the embodiments of the invention is executed. An embodiment is provided hereinafter to elaborate steps of this method in detail.

Figure 3:
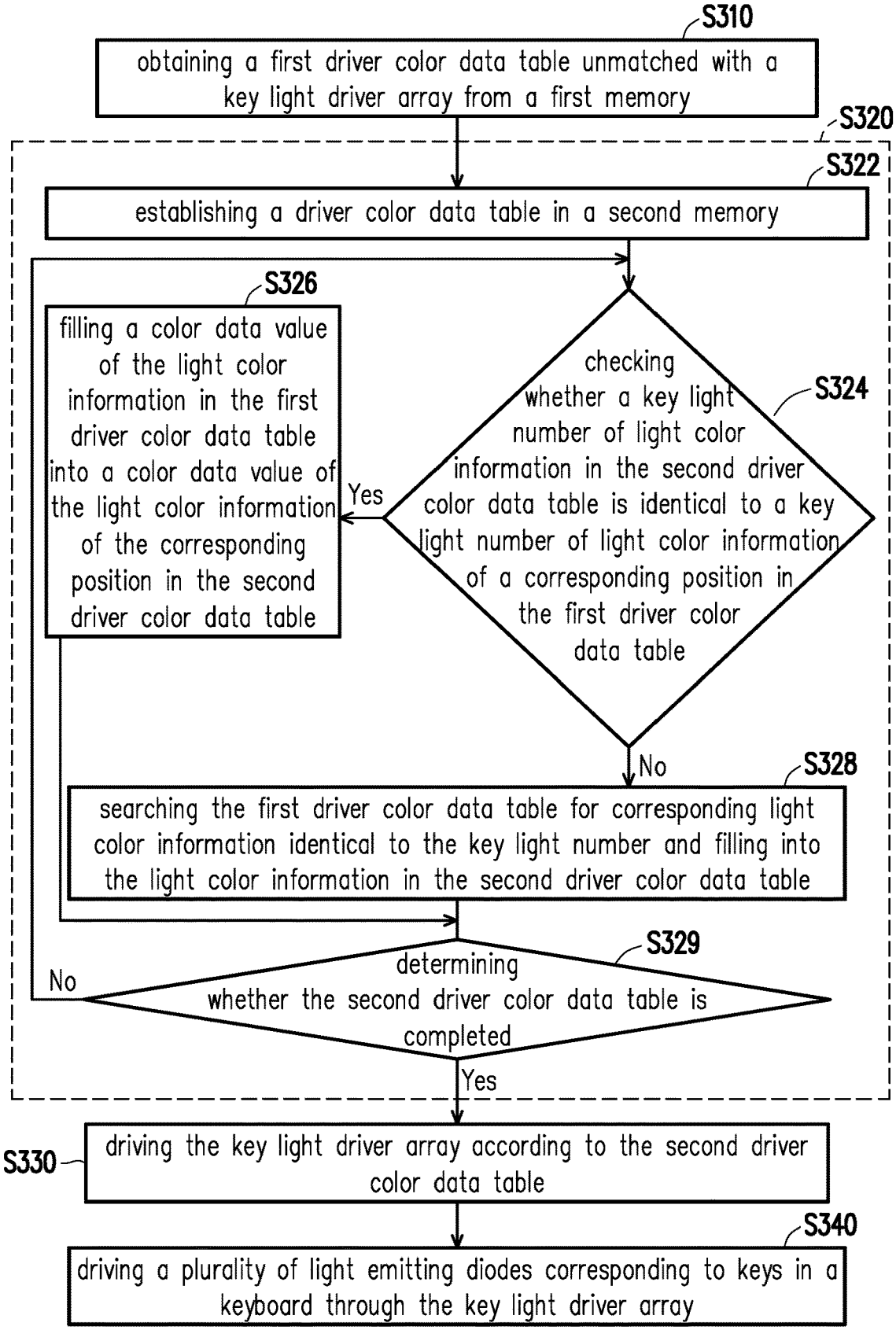
FIG. 3 is a flow chart of a driving method for light emitting diodes in a keyboard according to an embodiment of the invention.
Figure 4:
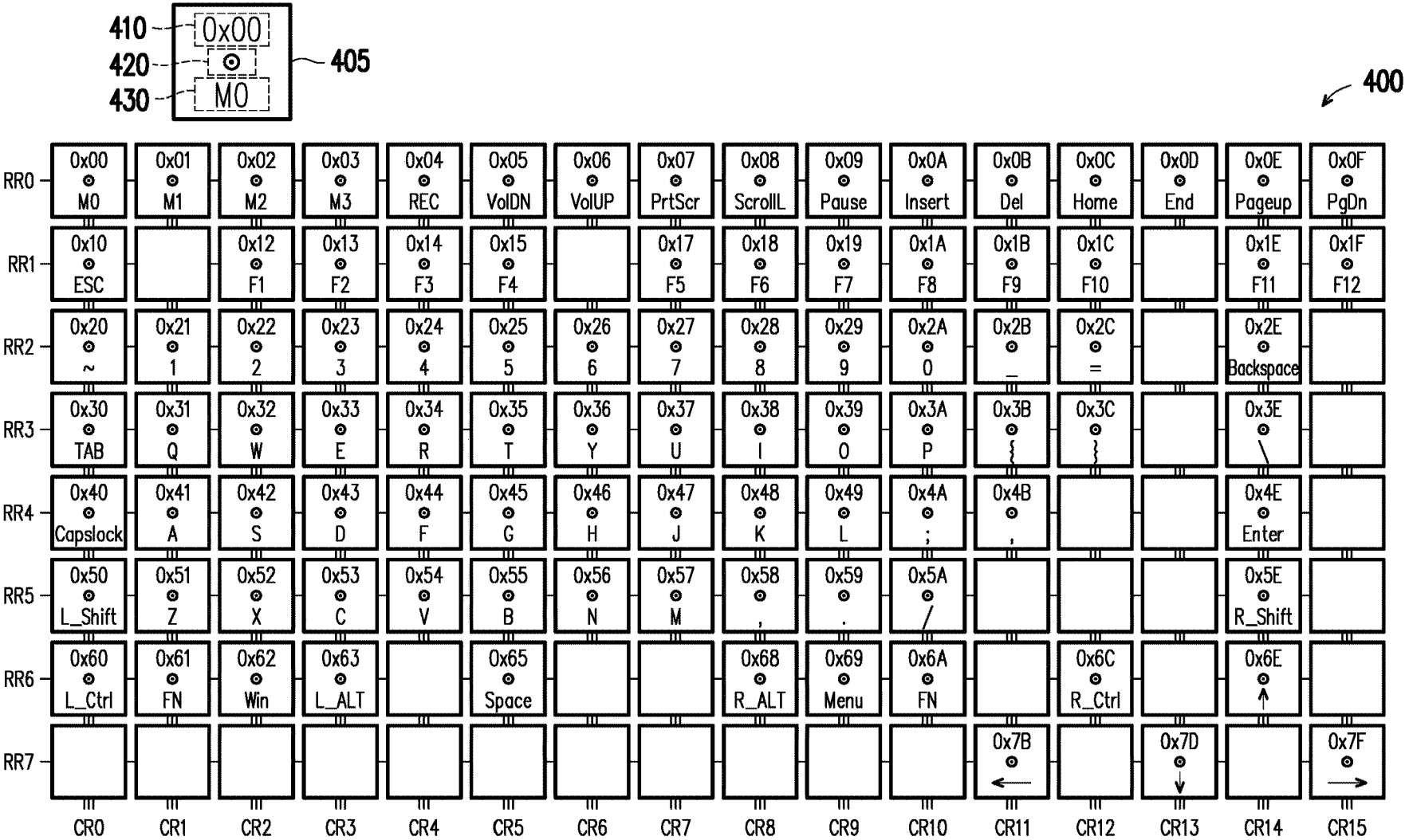
FIG. 4 is a schematic diagram of information presented by a key light driver array 400 according to an embodiment of the invention.

FIG. 3 is a flow chart of a driving method for light emitting diodes in a keyboard according to an embodiment of the invention. With reference to FIG. 2 and FIG. 3 together, the method of this embodiment is adapted to the driving apparatus 100 for light emitting diodes in a keyboard. The steps of the driving method for light emitting diodes in a keyboard of this embodiment is described in details along with the devices and elements of the driving apparatus 100 for light emitting diodes in a keyboard. Related information to be applied to the following embodiments is described herein. The first driver color data table 121 is driving data (driver color data table) generated according to a previous arrangement order of the keys based on an originally-known or originally-designed key light driver array (not the key light driver array 110). After the embodiment is implemented, the second driver color data table 131 matched with the present key light driver array 110 is expected to be generated. In this embodiment, information presented in a key light driver array 400 in FIG. 4 is the previous arrangement order and key distribution of keys of the key light driver array 400 matched with the first driver color data table 121. Note that the key light driver array 110 in FIG. 1 and FIG. 2 is implemented through information presented in a key light driver array 600 in FIG. 6 instead of the information presented in the key light driver array 400 in FIG. 4. A driver color data table 500 in FIG. 5 acts as the first driver color data table 121 in FIG. 1. The information presented in the key light driver array 600 in FIG. 6 is the present arrangement order and key distribution of keys of the key light driver array 600 unmatched with the first driver color data table 121. Note that the key light driver array 110 in FIG. 1 and FIG. 2 is implemented through the information presented in the key light driver array 600 in FIG. 6. Moreover, a driver color data table 700 in FIG. 7 acts as the second driver color data table 131 in FIG. 1.

First, the microprocessor 140 obtains the first driver color data table 121 unmatched with the key light driver array 110 from the first memory 120 (step S310). After the microprocessor 140 obtains the first driver color data table 121, the microprocessor 140 generates the second driver color data table 131 matched with the key light driver array 110 in the second memory 130 according to the arrangement order of the keys in the key light driver array 110 and the first driver color data table 121 (step S320). After the microprocessor 140 generates the second driver color data table 131, the microprocessor 140 drives the key light driver array 110 according to the second driver color data table 131 (step S330) and drives the light emitting diodes corresponding to the keys in the keyboard through the key light driver array 110 (step S340). Implementation of each steps in FIG. 3 is described in detail as follows.

Figure 5:
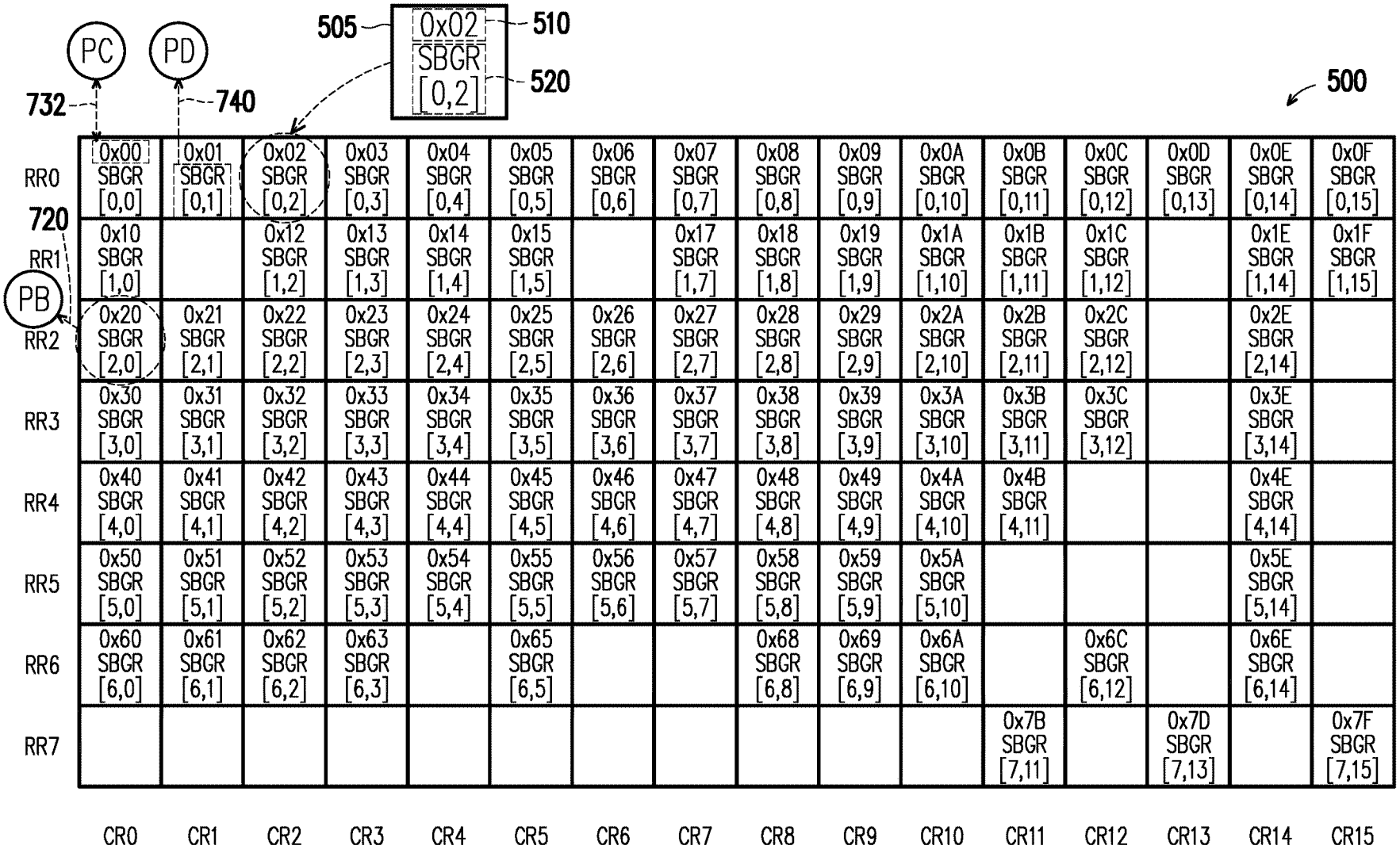
FIG. 5 is a schematic diagram of a first driver color data table 500 according to an embodiment of the invention.
Figure 6:
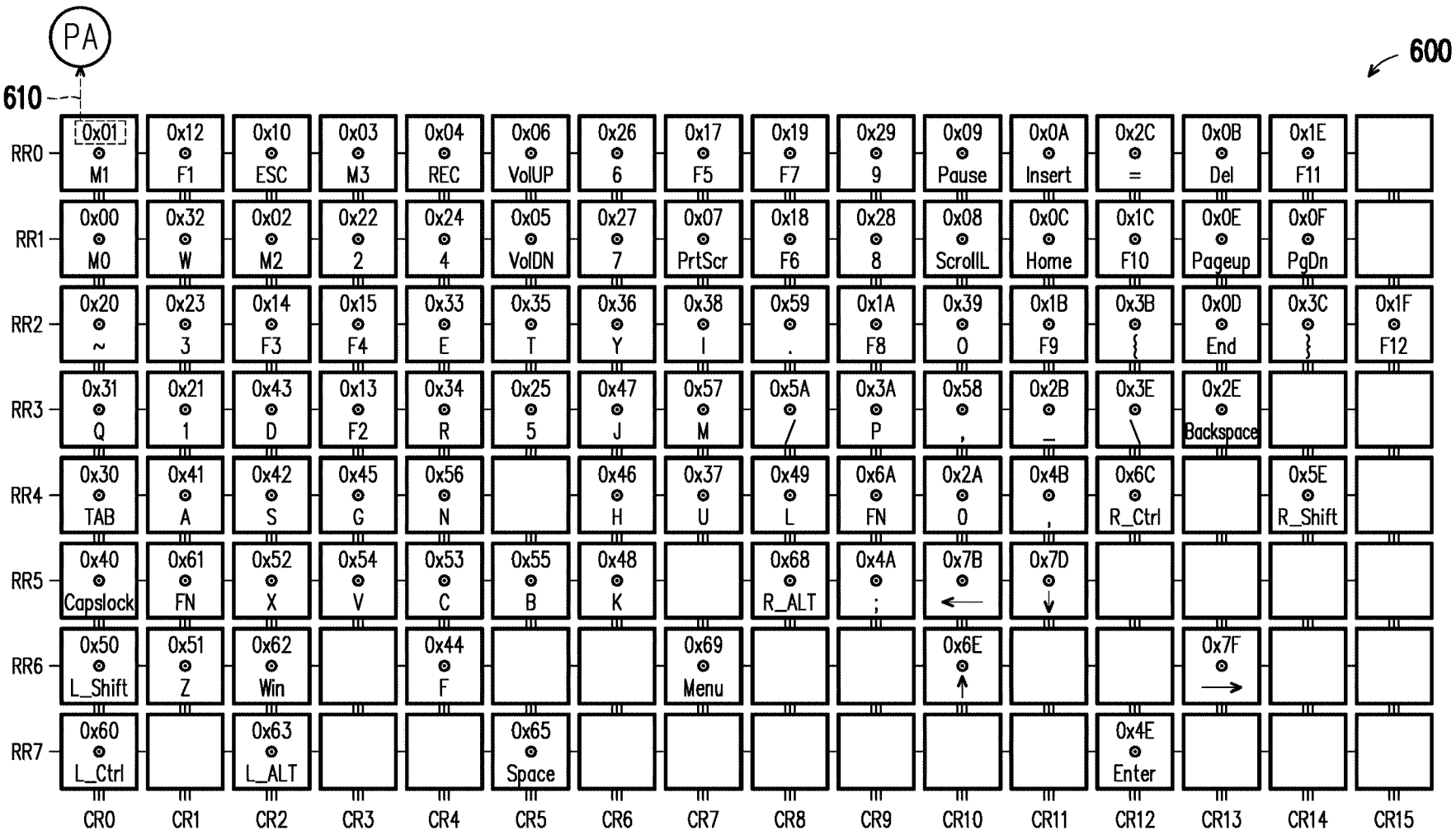
FIG. 6 is a schematic diagram of information presented by a key light driver array 600 according to an embodiment of the invention.

A driver color data table 500 in FIG. 5 (equivalent to the first driver color data table 121 in FIG. 2) is related to the information presented in the key light driver array 400 in FIG. 4. The key light driver array 400 of FIG. 4 and the driver color data table 500 of FIG. 5 are thus described first herein.

FIG. 4 is a schematic diagram of the information presented by the key light driver array 400 according to an embodiment of the invention. It can be seen in FIG. 4 that the information presented by the key light driver array 400 is composed of light arrangement information of 8 rows (a $0^{th}$ row RR0 to a $7^{th}$ row RR7) and 16 columns (a $0^{th}$ column CR0 to a $15^{th}$ column CR15). Each piece of the light arrangement information corresponds to a corresponding position of an $X^{th}$ row and a $Y^{th}$ column, where $0 \leq X \leq 7$ and $0 \leq Y \leq 15$. If the light arrangement information is not presented in the corresponding position, it means that no key nor key light is provided at that position. Herein, a block 405 in FIG. 4 is taken as an example to describe the light arrangement information of the corresponding position of the $0^{th}$ row RR0 and the $0^{th}$ column CR0. In FIG. 4, it can be seen that each one of the columns CR0 to CR15 has three traces, and each of the traces transmits a numerical value used by the blue light emitting diode, the green light emitting diode, or the red light emitting diode to drive the corresponding LED. The block 405 includes a key light number 410, a key light 420, and a key function 430. The key light number 410 of this embodiment is presented in a form of, for example, 0x00, 0x01, . . . , and 0x7F. The key light number 410 may also be regarded as a key light address. The key light 420 is mainly configured to present that a corresponding key light is provided in the key. The key function 430 is configured to present the function key on the keyboard corresponding to the key. For instance, the block 405 located on the $0^{th}$ row RR0 and the 0th column CR0 includes the key light number 410 of "0x00" and the key function of "MO", the light arrangement information located on the $0^{th}$ row RR0 and the $2^{nd}$ column CR2 includes the key light number of "0x02" and the key function of "M2", the light arrangement information located on the $3^{rd}$ row RR3 and the $0^{th}$ column CR0 includes the key light number of "0x30" and the key function of "TAB", and the light arrangement information located on the $3^{rd}$ row RR3 and the $1^{st}$ column CR1 includes the key light number of "0x31" and the key function of "Q". How the information presented by the key light driver array 110 is presented may be adjusted according to needs of people applying this embodiment. Nevertheless, each piece of the light arrangement information is required to include at least the position presented by a column and a row, the key light number corresponding to each position, and the key function.

FIG. 5 is a schematic diagram of the first driver color data table 500 according to an embodiment of the invention. The first driver color data table 500 is composed of light color information having 8 rows (a $0^{th}$ row RR0 to a $7^{th}$ row RR7) and 16 columns (a $0^{th}$ column CR0 to a $15^{th}$ column CR15). Each piece of the light color information corresponds to a corresponding position of an $X^{th}$ row and a $Y^{th}$ column, where $0 \leq X \leq 7$ and $0 \leq Y \leq 15$. If the light color information is not presented in the corresponding position, it means that no key nor key light is provided at that position. Light color information 505 of the corresponding position of the $0^{th}$ row RR0 and the $2^{nd}$ column CR2 is taken as an example to describe content of each piece of the light color information.

The light color information 505 at least includes a key light number 510 and a color data value 520. The key light number 510 of this embodiment is similar to that illustrated in FIG. 4 and is presented in a form of, for example, 0x00, 0x01, . . . , and 0x7F. The "the first driver color data table 500 is matched with the key light driver array 400 in FIG. 4" means that in the light arrangement information and the light color information of the corresponding positions of the same $X^{th}$ row and the same $Y^{th}$ column in the first driver color data table 500 and the key light driver array 400 have the same key light numbers. For instance, the key light number 510 in the light color information 505 of the $0^{th}$ row RR0 and the $2^{nd}$ column CR2 is identical to the key light number of the light arrangement information of the corresponding position of the $0^{th}$ row RR0 and the $2^{nd}$ column CR2 in FIG. 4 (i.e., both are "0x02").

The color data value 520 is the numerical value used by the microprocessor 140 in FIG. 2 to drive the blue light emitting diode, the green light emitting diode, and the red light emitting diode respectively by the diode drivers 111, 112, and 113. For instance, the color data value 520 in the light color information 505 is SBGR[0, 2]=(219, 172, 253), it means that the blue LED color value is 219, the green LED color value is 172, and the red LED color value is 253 in a source color data value SBGR[0, 2] of the $0^{th}$ row RR0 and the $2^{nd}$ column CR2. How the color data value 520 is presented may be changed by people applying this embodiment, and the embodiments of the invention are not limited thereto. In FIG. 4, the source color data value SBGR[X, Y] of the $X^{th}$ row and the $Y^{th}$ column is taken as an example for each color data value of each piece of the light color information.

FIG. 6 is a schematic diagram of the information presented by the key light driver array 600 according to an embodiment of the invention. The light arrangement information in the key light driver array 600 in FIG. 6 is presented in a manner similar to that shown in FIG. 4. Note that most of the key light numbers and key function keys in the light arrangement information in the key light driver array 600 are different from the key light numbers and key function keys of the key arrangement information of the corresponding positions in the key light driver array 400. As such, it means that the present arrangement order of the keys in the key light driver array 600 is different from the previous arrangement order of the keys in the key light driver array 400 in FIG. 4. In other words, in FIG. 4 and FIG.

6, the key light numbers corresponding to the key function keys (i.e., the key light addresses) are all identical, but arrangement orders of these key function keys in FIG. 4 and FIG. 6 are different from each other owing to trace configurations.

FIG. 7 is a schematic diagram of the second driver color data table 700 according to an embodiment of the invention. The second driver color data table 700 is an updated driver color data table generated after step S320 of FIG. 3 is performed in the embodiments of the invention. The first driver color data table 500 in FIG. 5 and the second driver color data table 700 in FIG. 7 of this embodiment are tables having sizes identical to sizes of the key light driver arrays 110, 400, and 600. In other applicable embodiments, the first driver color data table 500 and the second driver color data table 700 may also include other information or may be presented by other manners, and as such, the sizes of the tables 500 and 700 and the sizes of the key light driver arrays 110, 400, and 600 are different.

The step S322 to the step S329 of the step S320 in FIG. 3 are described in detail in FIG. 2, FIG. 5, FIG. 6, and FIG. 7. In step S322, the microprocessor 140 establishes the driver color data table 131 (corresponding to the driver color data table 700 of FIG. 7) in the second memory 130. In the above process, the key light numbers corresponding to the light arrangement information in the key light driver array 110 (corresponding to the key light driver array 600 of FIG. 6) in FIG. 2 act as the arrangement order of keys in the key light driver array 110 and are correspondingly stored into the light color information of the corresponding position of the driver color data table 131 (the driver color data table 700 of FIG. 7) in the second memory 130. Herein, arrows 610 and 710 and the indicators PA in FIG. 6 and FIG. 7 are used to present the key light number of the light arrangement information of the $0^{th}$ row RR0 and the $0^{th}$ column CR0 is correspondingly stored into the light color information of the $0^{th}$ row RR0 and the 0th column CR0.

In step S324, the microprocessor 140 checks whether the key light number of each piece of the light color information in the second driver color data table 131 (the driver color data table 700 of FIG. 7) is identical to the key light number of the light color information of the corresponding position in the first driver color data table 121 (the driver color data table 500 of FIG. 5).

When the key light number of the light color information in the second driver color data table 700 is identical to the key light number of the light color information of the corresponding position in the first driver color data table 500, step S326 is performed after step S324. The microprocessor 140 fills the color data value of the light color information in the first driver color data table 500 into the color data value of the light color information of the corresponding position in the second driver color data table 700. Herein, arrows 720 and 722 and indicators PB in FIG. 5 and FIG. 7 are used for presentation. For instance, since the key light number "0X20" of the light arrangement information of the $2^{nd}$ row RR2 and the $0^{th}$ column CR0 in FIG. 5 is identical to the key light number "0X20" of the light arrangement information of the $2^{nd}$ row RR2 and the $0^{th}$ column CR0 in FIG. 7, the microprocessor 140 fills the source color data value SBGR[2, 0] of the light arrangement information of the $2^{nd}$ row RR2 and the 0th column CR0 in FIG. 5 into a target color data value DBGR[2, 0] of the light arrangement information of the $2^{nd}$ row RR2 and the $0^{th}$ column CR0 in FIG. 7. In this way, the source color data value SBGR[2, 0] is identical to the target color data value DBGR[2, 0]. After step S326 is completed, step S324 is performed, and that whether the following key light number of the light color information in the second driver color data table 700 is identical to the key light number of the light color information of the corresponding position in the first driver color data table 500 is determined next.

Conversely, when the key light number of the light color information in the second driver color data table 700 is not identical to the key light number of the light color information of the corresponding position in the first driver color data table 500, it means that the light color information is required to be modified owing to difference trace configurations. Therefore, step S328 is performed after step S324, and the microprocessor 140 searches the first driver color data table 500 for corresponding light color information identical to the key light number of the light color information in the second driver color data table 700 and fills a corresponding color data value of the corresponding light color information into the color data value of the light color information in the second driver color data table 700. For instance, as shown by arrows 730 and 732 and the indicators PC in FIG. 5 and FIG. 7, the key light number "0x01" of the light color information of the $0^{th}$ row RR0 and the $0^{th}$ column CR0 in FIG. 7 is different from the key light number "0x00" of the light color information of the corresponding position in FIG. 5, and the microprocessor 140 thus searches the light color information in the first driver color data table 500 in FIG. 5 for the light color information having the key light number of "0x01" (e.g., the corresponding light color information of the $0^{th}$ row RR0 and the $1^{st}$ column CR1 in FIG. 5). As shown by arrows 740 and 742 and indicators PD in FIG. 5 and FIG. 7, the microprocessor 140 fills the corresponding color data value of the corresponding light color information of the $0^{th}$ row RR0 and the $1^{st}$ column CR1 in FIG. 5 (i.e., the source color data value SBGR[0, 1]) into the color data value of the light color information of the $0^{th}$ row RR0 and the $0^{th}$ column CR0 in the second driver color data table 700 in FIG. 7 (i.e., the target color data value DBGR[0, 0]). In this way, after step S322 to step S328 is performed by the microprocessor 140 to each piece of the light color information in the second driver color data table 700, the microprocessor 140 may fill the color data values of all light color information in the second driver color data table 700. The microprocessor 140 may then drives the key light driver array 110 according to the second driver color data table 131 in step S330 to drive the light emitting diodes of the keys corresponding to the key light driver array 110, so as to present lighting effects on the correct key positions. After step S326 or step S328 is completed, step S329 is performed, and whether the second driver color data table 131 is completed is thus determined. Specifically, the condition of determining whether the second driver color data table 131 is completed is to see whether each piece of the light color information in the second driver color data table 131 has a corresponding numerical value. If part of the light color information in the second driver color data table 131 does not have corresponding numerical values, it means that the second driver color data table 131 is not completed, and step S324 is thereby performed after step S329. In this way, a corresponding numerical value can be filled into each piece of the light color information in the second driver color data table 131 through steps S324, S326, and S328. As such, the second driver color data table 131 can be completed.

Note that the description in this embodiment is provided based on each piece of data in the second driver color data table 131 (the driver color data table 700 in FIG. 7). For instance, in steps S324, S326, and S328, the first driver color data table 121 (the driver color data table 500 in FIG. 5) is retrieved for the related information in the second driver color data table 131 (the driver color data table 700 in FIG. 7). The related information in the first driver color data table 121 (the driver color data table 500 in FIG. 5) is copied or moved to the corresponding positions of the second driver color data table 131 (the driver color data table 700 in FIG. 7), so that the second driver color data table 131 (the driver color data table 700 in FIG. 7) is thereby completed. In other embodiments consistent with the invention, the description may be provided based on each piece of data in the first driver color data table 121 (the driver color data table 500 in FIG. 5). For instance, the corresponding positions of the second driver color data table 131 (the driver color data table 700 in FIG. 7) may be filled for the related information in the first driver color data table 121 (the driver color data table 500 in FIG. 5), so that the second driver color data table 131 (the driver color data table 700 in FIG. 7) is thereby completed. People applying this embodiment may complete related operation of the second driver color data table 131 (the driver color data table 700 in FIG. 7) based on each piece of data in the first driver color data table 121 (the driver color data table 500 in FIG. 5) through the foregoing embodiments.

Figure 8:
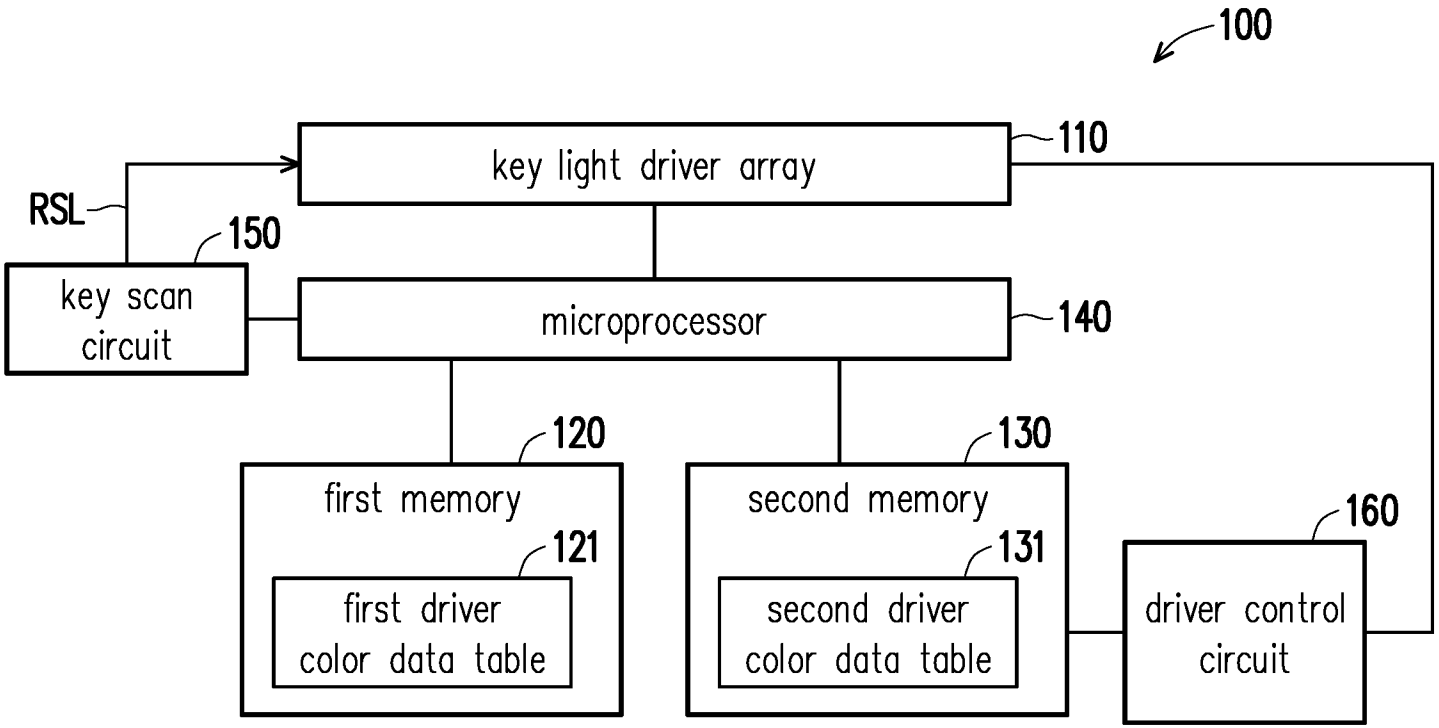
FIG. 8 is a block view illustrating the driving apparatus for light emitting diodes in a keyboard in detail according to another embodiment of the invention.

FIG. 8 is a block view illustrating the driving apparatus 100 for light emitting diodes in a keyboard in detail according to another embodiment of the invention. With reference to FIG. 8, the key light driver array 110, the first memory 120, the second memory 130, the microprocessor 140, and the key scan circuit 150 in FIG. 8 are identical to the key light driver array 110, the first memory 120, the second memory 130, the microprocessor 140, and the key scan circuit 150 in FIG. 2. A difference therebetween is that the driving apparatus 100 for light emitting diodes in a keyboard in FIG. 8 further includes a driver control circuit 160. The driving apparatus 100 for light emitting diodes in a keyboard in this embodiment utilizes the driver control circuit 160 to drive the key light driver array 110 according to the second driver color data table 131, so as to drive the light emitting diodes of the keys corresponding to the key light driver array 110, so that lighting effects are presented on the correct key positions.

Figure 9:
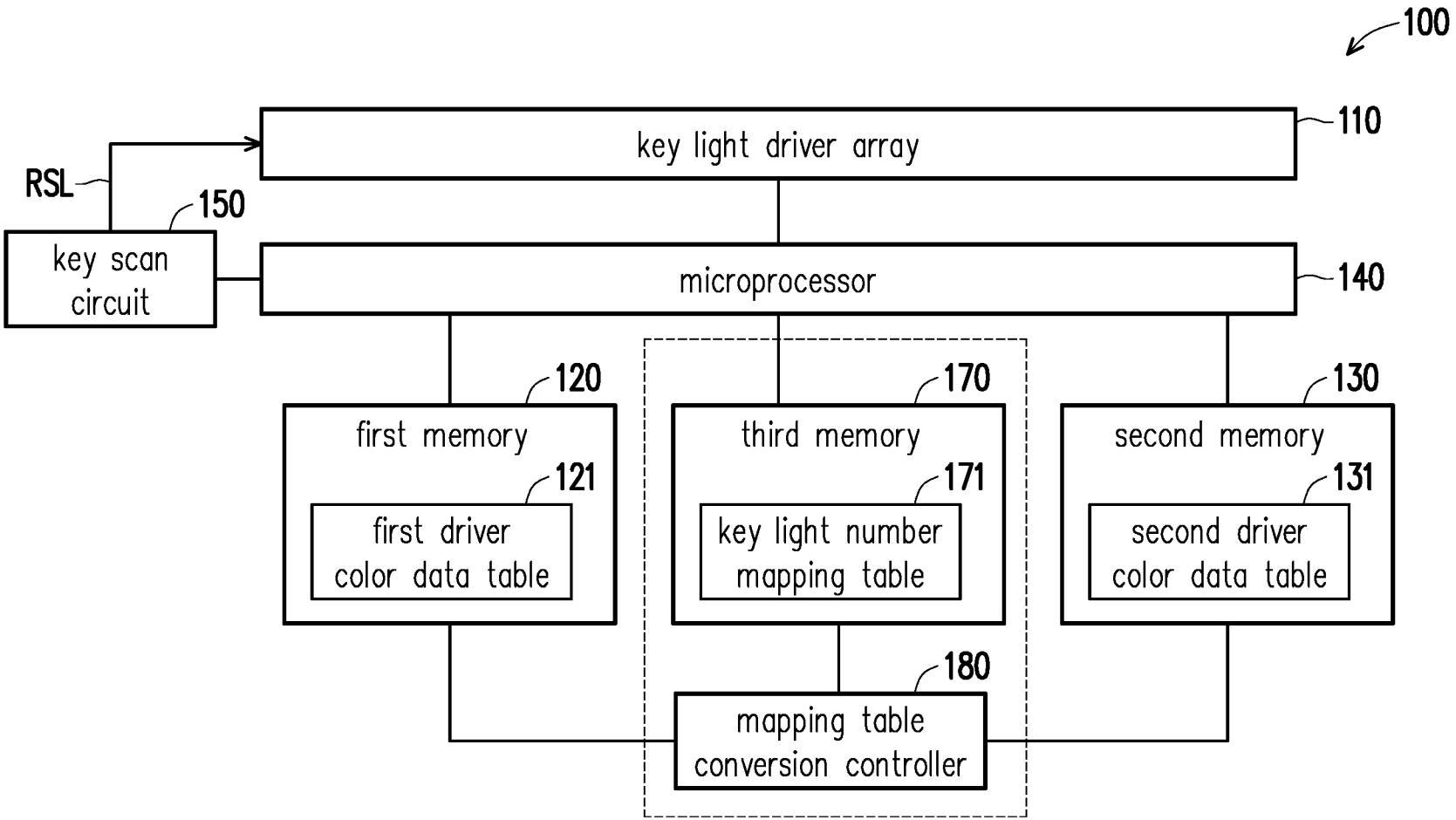
FIG. 9 is a block view illustrating the driving apparatus for light emitting diodes in a keyboard in detail according to another embodiment of the invention.

FIG. 9 is a block view illustrating the driving apparatus 100 for light emitting diodes in a keyboard in detail according to another embodiment of the invention. With reference to FIG. 9, the key light driver array 110, the first memory 120, the second memory 130, the microprocessor 140, and the key scan circuit 150 in FIG. 9 are identical to the key light driver array 110, the first memory 120, the second memory 130, the microprocessor 140, and the key scan circuit 150 in FIG. 2. A difference therebetween is that the driving apparatus 100 for light emitting diodes in a keyboard in FIG. 9 further includes a third memory 170 and a mapping table conversion controller 180. The third memory 170, for example, is a fixed or a movable random access memory (RAM) in any form, a read-only memory (ROM), a flash memory, any other similar device, or a combination of the foregoing devices.

In this embodiment, the microprocessor 140 is coupled to the key light driver array 110, the key scan circuit 150, the first memory 120, the second memory 130, and the third memory 170. Moreover, the mapping table conversion controller 180 is coupled to the first memory 120, the second memory 130, and the third memory 170, so that a driving method for light emitting diodes in a keyboard provided by another embodiment of the invention is executed. An embodiment is provided hereinafter to elaborate steps of this method in detail.

Figure 10:
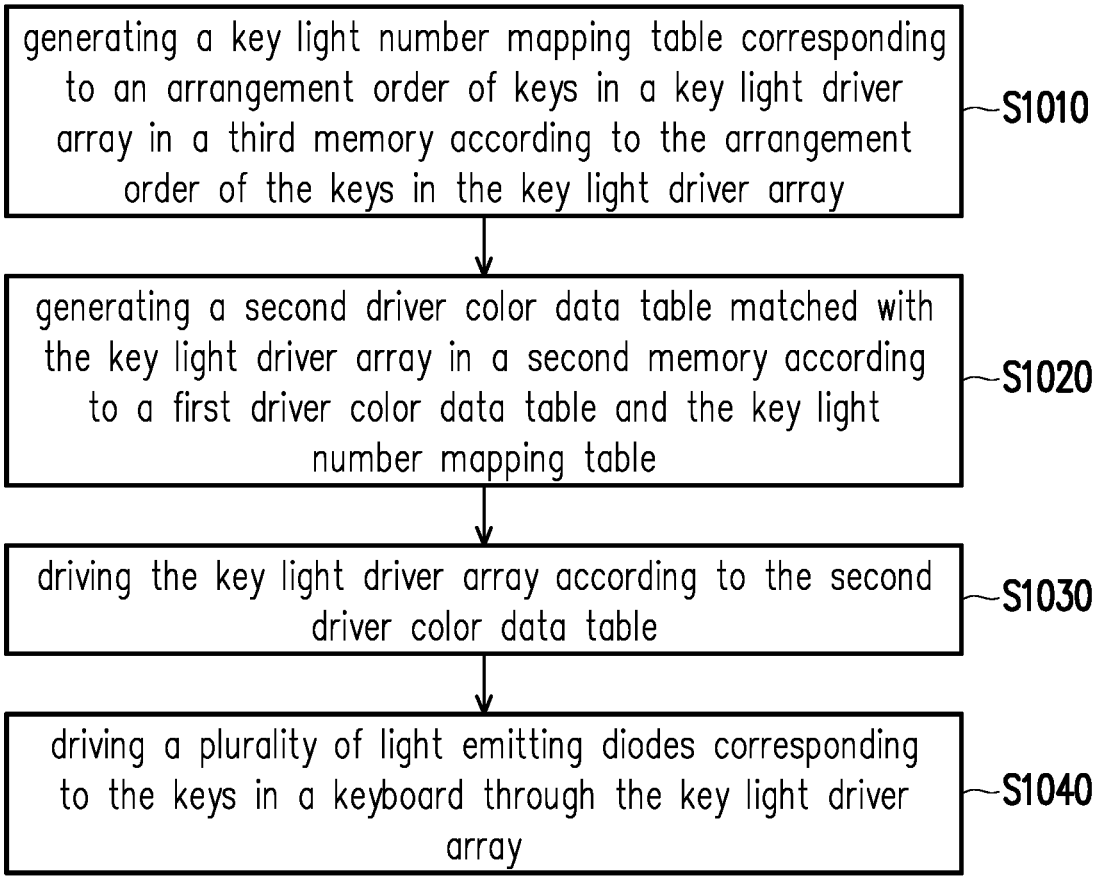
FIG. 10 is a flow chart of a driving method for light emitting diodes in a keyboard according to another embodiment of the invention.

FIG. 10 is a flow chart of a driving method for light emitting diodes in a keyboard according to another embodiment of the invention. With reference to FIG. 9 and FIG. 10 together, the method of this embodiment is adapted to the driving apparatus 100 for light emitting diodes in a keyboard in FIG. 9. The steps of the driving method for light emitting diodes in a keyboard of this embodiment is described in details along with the devices and elements of the driving apparatus 100 for light emitting diodes in a keyboard of FIG. 9.

First, the microprocessor 140 of this embodiment generates a key light number mapping table 171 corresponding to the arrangement order of the keys in the key light driver array 110 in the third memory 170 according to the arrangement order of the keys in the key light driver array 110 (step S1010). Specifically, the microprocessor 140 establishes the key light number mapping table 171 in the third memory 170. In the above process, the key light numbers corresponding to the light arrangement information in the key light driver array 110 in FIG. 9 act as the arrangement order of keys in the key light driver array 110 and are correspondingly stored into information of the corresponding positions of the key light number mapping table 171 in the third memory 170. The key light number mapping table 171 of this embodiment is a table having a size identical to the size of the key light driver array 110. In other applicable embodiments, the key light number mapping table 171 may also include other information or may be presented by other manners, and as such, the sizes of the key light number mapping table 171 and the key light driver array 110 are different.

After the microprocessor 140 generates the key light number mapping table 171, the mapping table conversion controller 180 generates the second driver color data table 131 matched with the key light driver array 110 in the second memory 130 according to the first driver color data table 121 and the key light number mapping table 171 (step S1020). Step S1020 of this embodiment may also be performed by the microprocessor 140, which is not limited in this regard. Next, identical to steps S330 and S340 in FIG. 3, the microprocessor 140 drives the key light driver array 110 according to the second driver color data table 131 (step S1030) and drives the light emitting diodes corresponding to the keys in the keyboard through the key light driver array 110 (step S1040).

Note that in other embodiments, step S1020 is performed by the microprocessor 140, and the third memory 170 is not required. Through such manner adopted by other embodiments, the microprocessor 140 reads the first driver color data table 121 with reference to key light number mapping table inside a program so as to generate the second driver color data table 131, and that the second driver color data table 131 is generated in the second memory 130.

Figure 11:
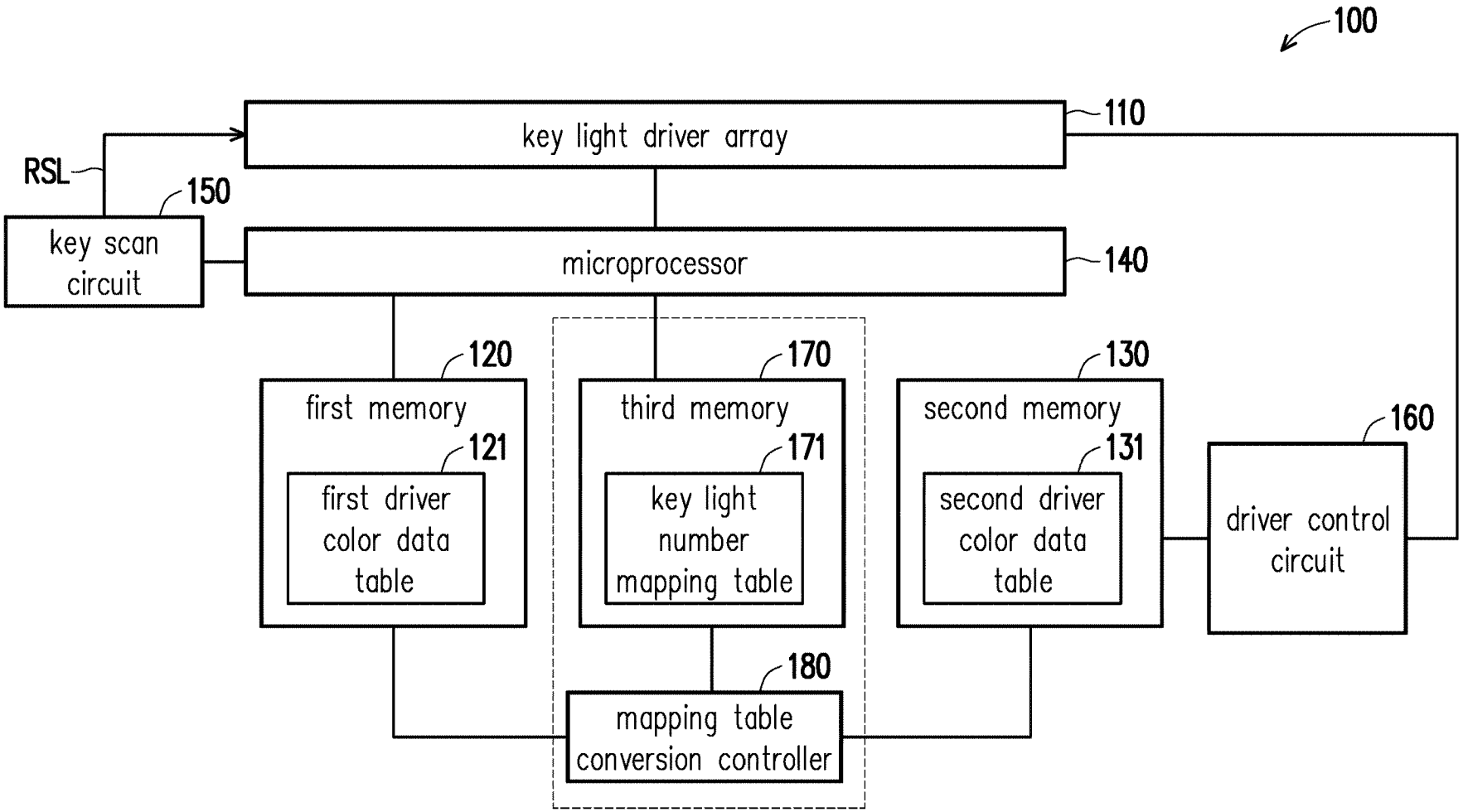
FIG. 11 is a block view illustrating the driving apparatus for light emitting diodes in a keyboard in detail according to another embodiment of the invention.

FIG. 11 is a block view illustrating the driving apparatus 100 for light emitting diodes in a keyboard in detail according to another embodiment of the invention. With reference to FIG. 11, the key light driver array 110, the first memory 120, the second memory 130, the microprocessor 140, the key scan circuit 150, the third memory 170, and the mapping table conversion controller 180 in FIG. 11 are identical to the key light driver array 110, the first memory 120, the second memory 130, the microprocessor 140, the key scan circuit 150, the third memory 170, and the mapping table conversion controller 180 in FIG. 9. A difference therebetween is that the driving apparatus 100 for light emitting diodes in a keyboard in FIG. 11 further includes the driver control circuit 160, and the microprocessor 140 is not required to be coupled to the second memory 130. The driving apparatus 100 for light emitting diodes in a keyboard in this embodiments uses the same manner used by the driving apparatus 100 for light emitting diodes in a keyboard of FIG. 8 to drive the key light driver array 110, and both driving apparatuses 100 for light emitting diodes in a keyboard utilize the driver control circuit 160 to drive the key light driver array 110 according to the second driver color data table 131, so as to drive the light emitting diodes of the keys corresponding to the key light driver array 110, so that lighting effects are presented on the correct key positions.

In view of the foregoing, in the driving method and driving apparatus for light emitting diodes in a keyboard provided by the embodiments of the invention, the second driver color data table matched with the key light driver array is generated through the first driver color data table unmatched with the key light driver array, the arrangement order of the keys in the key light driver array (that is, the present arrangement order of the keys), and the arrangement order of the keys matched with the first driver color data table (that is, the previous arrangement order of the keys). The key light driver array and the light emitting diodes corresponding to the keys are thereby driven. In this way, when positions of the traces on the circuit board carrying the keys and the corresponding key lights are shifted and that the arrangement order of the key lights is unmatched with the driving data (e.g., the driver color data table), the driving data can be rapidly and automatically updated according to the present arrangement order of the keys and the previous arrangement order of the keys. Therefore, time consumed for design and research and development of illumination effects on illuminated keyboards can be saved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving method for light emitting diodes in a keyboard, comprising:

obtaining a first driver color data table unmatched with a key light driver array from a first memory;

generating a second driver color data table matched with the key light driver array in a second memory according to an arrangement order of keys in the key light driver array and the first driver color data table;

driving the key light driver array according to the second driver color data table so as to drive the light emitting diodes corresponding to the keys of the keyboard through the key light driver array, wherein the step of generating the second driver color data table matched with the key light driver array in the second memory according to the arrangement order of the keys in the key light driver array and the first driver color data table comprises:

establishing the second driver color data table in the second memory and treating key light numbers corresponding to a plurality of pieces of light arrangement information in the key light driver array as the arrangement order of the keys in the key light driver array and correspondingly storing the key light numbers to a plurality of key light numbers of a plurality of pieces of light color information of corresponding positions of the second driver color data table; and checking whether the key light numbers of the light color information in the second driver color data table are identical to key light numbers of key light information of corresponding positions in the first driver color data table.

2. The driving method as claimed in claim 1, wherein the step of generating the second driver color data table matched with the key light driver array in the second memory according to the arrangement order of the keys in the key light driver array and the first driver color data table further comprises:

filling color data values of the light color information in the first driver color data table into color data values of the light color information of corresponding positions in the second driver color data table when the key light numbers of the light color information in the second driver color data table are identical to the key light numbers of the light color information of the corresponding positions in the first driver color data table; and searching the first driver color data table for corresponding light color information identical to the key light numbers of the light color information in the second driver color data table and filling corresponding color data values corresponding to the light color information into the color data values of the light color information in the second driver color data table when the key light numbers of the light color information in the second driver color data table are different from the key light numbers of the corresponding positions of the light color information in the first driver color data table.

3. The driving method as claimed in claim 1, wherein each of the first driver color data table and the second driver color data table comprises a plurality of pieces of light color information composed of a plurality of rows and a plurality of columns, and each pieces of the light color information comprises a key light number and a color data value.

4. The driving method as claimed in claim 1, wherein the first driver color data table and the second driver color data table are tables equal to the key light driver array.

5. The driving method as claimed in claim 1, wherein the light emitting diodes corresponding to each of the keys comprise at least a blue light emitting diode, a green light emitting diode, and a red light emitting diode.

6. The driving method as claimed in claim 1, wherein the light emitting diode corresponding to each of the keys comprises a monochromatic light emitting diode.

7. A driving apparatus for light emitting diodes in a keyboard, comprising:

a key light driver array, comprising the light emitting diodes corresponding to a plurality of keys in the keyboard;

a first memory and a second memory, the first memory configured to store or temporarily store a first driver color data table, the first driver color data table unmatched with the key light driver array; and a microprocessor, coupled to the first memory, the second memory, and the key light driver array, wherein the microprocessor obtains the first driver color data table unmatched with the key light driver array from the first memory and generates a second driver color data table matched with the key light driver array in the second memory according to an arrangement order of the keys in the key light driver array and the first driver color data table, and the microprocessor drives the key light driver array according to the second driver color data table, wherein the microprocessor establishes the second driver color data table in the second memory, treats key light numbers corresponding to a plurality of pieces of light arrangement information in the key light driver array as the arrangement order of the keys in the key light driver array and correspondingly stores the key light numbers to a plurality of key light numbers of a plurality of pieces of light color information of corresponding positions of the second driver color data table, and checks whether the key light numbers of the light color information in the second driver color data table are identical to key light numbers of key light information of corresponding positions in the first driver color data table.

8. The driving apparatus as claimed in claim 7, wherein the microprocessor filling color data values of the light color information in the first driver color data table into color data values of the light color information of corresponding positions in the second driver color data table when the key light numbers of the light color information in the second driver color data table are identical to the key light numbers of the light color information of the corresponding positions in the first driver color data table, the microprocessor searching the first driver color data table for corresponding light color information identical to the key light numbers of the light color information in the second driver color data table and filling corresponding color data values corresponding to the light color information into the color data values of the light color information in the second driver color data table when the key light numbers of the light color information in the second driver color data table are different from the key light numbers of the corresponding positions of the light color information in the first driver color data table.

9. The driving apparatus as claimed in claim 7, wherein each of the first driver color data table and the second driver color data table comprises a plurality of pieces of light color information composed of a plurality of rows and a plurality of columns, and each pieces of the light color information comprises a key light number and a color data value.

10. The driving apparatus as claimed in claim 7, wherein the first driver color data table and the second driver color data table are tables equal to the key light driver array.

11. The driving apparatus as claimed in claim 7, wherein the light emitting diodes corresponding to each of the keys comprise at least a blue light emitting diode, a green light emitting diode, and a red light emitting diode.

12. The driving apparatus as claimed in claim 7, wherein the light emitting diode corresponding to each of the keys comprises a monochromatic light emitting diode.

13. A driving apparatus for light emitting diodes in a keyboard, comprising:

a key light driver array, comprising the light emitting diodes corresponding to a plurality of keys in the keyboard;

a first memory and a second memory, the first memory configured to store or temporarily store a first driver color data table, the first driver color data table unmatched with the key light driver array;

a microprocessor, coupled to the first memory, the second memory, and the key light driver array; and a driver control circuit, coupled to the second memory and the key light driver array, wherein the microprocessor obtains the first driver color data table unmatched with the key light driver array from the first memory and generates a second driver color data table matched with the key light driver array in the second memory according to an arrangement order of the keys in the key light driver array and the first driver color data table, and the driver control circuit drives the key light driver array according to the second driver color data table, wherein the microprocessor establishes the second driver color data table in the second memory, treats key light numbers corresponding to a plurality of pieces of light arrangement information in the key light driver array as the arrangement order of the keys in the key light driver array and correspondingly stores the key light numbers to a plurality of key light numbers of a plurality of pieces of light color information of corresponding positions of the second driver color data table, and checks whether the key light numbers of the light color information in the second driver color data table are identical to key light numbers of key light information of corresponding positions in the first driver color data table.

14. A driving method for light emitting diodes in a keyboard, comprising:

generating a key light number mapping table corresponding to an arrangement order of keys in a key light driver array according to the arrangement order of the keys in the key light driver array;

generating a second driver color data table matched with the key light driver array in a second memory according to a first driver color data table stored or temporarily stored in a first memory and the key light number mapping table; and driving the key light driver array according to the second driver color data table so as to drive the light emitting diodes corresponding to the keys of the keyboard through the key light driver array, wherein the step of generating the key light number mapping table corresponding to the arrangement order of the keys in the key light driver array according to the arrangement order of the keys in the key light driver array comprises:

establishing the key light number mapping table and treating key light numbers corresponding to a plurality of pieces of light arrangement information in the key light driver array as the arrangement order of the keys in the key light driver array and correspondingly storing the key light numbers to a plurality of pieces of key light number information of corresponding positions of the key light number mapping table.

15. The driving method as claimed in claim 14, wherein the key light number mapping table is a table equal to the key light driver array.

16. A driving apparatus for light emitting diodes in a keyboard, comprising:

a key light driver array, comprising the light emitting diodes corresponding to a plurality of keys in the keyboard;

a first memory, a second memory, and a third memory, the first memory configured to store or temporarily store a first driver color data table, the first driver color data table unmatched with the key light driver array;

a microprocessor, coupled to the first memory, the second memory, the third memory, and the key light driver array; and a mapping table conversion controller, coupled to the first memory, the second memory, and the third memory, wherein the microprocessor generates a key light number mapping table corresponding to an arrangement order of keys in the key light driver array in the third memory according to the arrangement order of the keys in the key light driver array, the mapping table conversion controller generates a second driver color data table matched with the key light driver array in the second memory according to the first driver color data table and the key light number mapping table, and the microprocessor drives the key light driver array according to the second driver color data table.

17. The driving apparatus as claimed in claim 16, wherein the microprocessor establishes the key light number mapping table in the third memory and treats key light numbers corresponding to a plurality of pieces of light arrangement information in the key light driver array as the arrangement order of the keys in the key light driver array and correspondingly stores the key light numbers to a plurality of pieces of key light number information of corresponding positions of the key light number mapping table.

18. The driving apparatus as claimed in claim 16, wherein the key light number mapping table is a table equal to the key light driver array.

19. A driving apparatus for light emitting diodes in a keyboard, comprising:

a key light driver array, comprising the light emitting diodes corresponding to a plurality of keys in the keyboard;

a first memory, a second memory, and a third memory, the first memory configured to store or temporarily store a first driver color data table, the first driver color data table unmatched with the key light driver array;

a microprocessor, coupled to the first memory, the third memory, and the key light driver array;

a mapping table conversion controller, coupled to the first memory, the second memory, and the third memory; and a driver control circuit, coupled to the second memory and the key light driver array, wherein the microprocessor generates a key light number mapping table corresponding to an arrangement order of keys in the key light driver array in the third memory according to the arrangement order of the keys in the key light driver array, the mapping table conversion controller generates a second driver color data table matched with the key light driver array in the second memory according to the first driver color data table and the key light number mapping table, and the driver control circuit drives the key light driver array according to the second driver color data table.

20. The driving apparatus as claimed in claim 19, wherein the microprocessor establishes the key light number mapping table in the third memory and treats key light numbers corresponding to a plurality of pieces of light arrangement information in the key light driver array as the arrangement order of the keys in the key light driver array and correspondingly stores the key light numbers to a plurality of pieces of key light number information of corresponding positions of the key light number mapping table.

21. The driving apparatus as claimed in claim 19, wherein the key light number mapping table is a table equal to the key light driver array.

* * * * *